US005165648A

United States Patent [19]

Quigley

[11] Patent Number: 5,165,648

[45] Date of Patent: Nov. 24, 1992

[54] BOOK HOLDER APPARATUS

[76] Inventor: Wanda L. Quigley, 1950 Connell Rd., Ortonville, Mich. 48462-9711

[21] Appl. No.: 811,165

[22] Filed: Dec. 19, 1991

[51] Int. Cl.[5] ..... A47B 97/04

[52] U.S. Cl. ..... 248/451; 248/444

[58] Field of Search ..... 248/451–453, 248/441.1, 444, 460

[56] References Cited

U.S. PATENT DOCUMENTS

| | | | |
|---|---|---|---|
| 2,807,908 | 10/1957 | Lykes | 248/451 |
| 3,065,565 | 11/1962 | Goodman | 248/451 |
| 3,951,374 | 4/1976 | Quigley | 248/451 |
| 4,555,084 | 11/1985 | Anderson et al. | 248/460 |
| 4,555,128 | 11/1985 | White et al. | 248/451 X |

*Primary Examiner*—Alvin C. Chin-Shue
*Attorney, Agent, or Firm*—Harness, Dickey & Pierce

[57] ABSTRACT

A book holder for releasably supporting and maintaining a book in an open position to facilitate reading. The book holder comprises an integrally formed base molded from foamable plastic. The base has an inclined support member having a front surface, a front portion spaced laterally apart from the front surface, and rear, bottom, top and side portions. The front portion further includes a protruding shoulder portion and a generally planar support surface which forms a channel with the protruding shoulder portion and a lowermost portion of the front surface of the inclined support member. The inclined support member further includes a first elastic strap vertically bisecting the front surface thereof and a second elastic strap extending through portions of the front surface on opposite sides of the first elastic strap. The first elastic strap is operable to be placed over a binder portion of a book while the portions of the second elastic strap extend over the front surface on opposite sides of the first strap and operate to hold the pages of the book securely and releasably in an open position. In a preferred embodiment the bottom portion includes a generally semi-circular cut-out section for enabling the base to be placed on a leg of a user. The side portions are also angled outwardly from each other in diverging relationship relative to the bottom portion to enable the base to be supported in a sideways position to facilitate reading while laying down on one's side in bed. In an alternative preferred embodiment, the book holder includes an elastic strap disposed horizontally across the inclined support member and generally parallel with the channel.

13 Claims, 3 Drawing Sheets

BOOK HOLDER APPARATUS

TECHNICAL FIELD

The invention relates to book holders, and more particularly to a book holder having an integrally formed base molded from a foamable plastic.

BACKGROUND

Book holders are used in a wide variety of applications in home and business environments to support large and small books in open positions, to thereby leave a reader of the book free to do other chores such as typing, writing, etc., while periodically viewing the book. Prior art book holders have heretofore tended to be somewhat cumbersome or impractical to use, and further not particularly well suited to securely supporting books of varying sizes.

A significant step forward in the book holder art is a book holder disclosed in U.S. Pat. No. 3,951,374, issued Apr. 20, 1976. The disclosure of this patent is hereby incorporated by reference. This book holder is made of a foamable plastic material, and has proven to provide a more secure apparatus for supporting variously sized books in an open position.

While the above-mentioned book holder in U.S. Pat. No. 3,951,374 has proven to be a significant step forward in the art, it would be even further desirable to produce a book holder which is even more suitable for holding variously sized books, and which is operable to allow a book to be placed thereon even more easily and to be supported in an even more stable fashion.

Accordingly, it is a principal object of the present invention to provide a book holder having an integrally formed molded base from a foamable plastic, which is lightweight, sturdy, and relatively inexpensive to manufacture.

It is still a further object of the present invention to provide a book holder which is adapted to even more securely hold a book in an open position thereon.

It is still another object of the present invention is to provide a book holder that is particularly well adapted for holding books of varying thicknesses and permitting the pages thereof to be turned and read easily.

It is still a further object of the present invention to provide a book holder which incorporates some means by which it may be easily carried and transported.

SUMMARY OF THE INVENTION

The above and other objects are provided by a book holder in accordance with preferred embodiments of the present invention. The book holder generally comprises an integrally formed base molded from foamable plastic. The base generally includes an inclined support member and a front portion spaced laterally apart from a front surface of the inclined support member. The front portion includes a protruding shoulder portion and a generally planar support surface extending transversely from the front portion. Together, the protruding shoulder portion, generally planar support surface and front surface of the inclined support member form a channel for supporting and confining a lower edge portion of a book in an open position.

Further included is means for releasably securing the book to the inclined support member. In a preferred embodiment this comprises a first elastic strap which vertically bisects the front surface of the inclined support member, and a second elastic strap which extends over and through portions of the front surface on opposite sides of the first elastic strap. The portions of the second elastic strap extending over a front surface are used to releasably hold the pages of the book in an open position.

In one preferred embodiment of the invention a carrying strap is incorporated and secured to the bottom portion of the base, for enabling the book holder to be easily carried.

In an alternative preferred embodiment the present invention includes means for releasably securing the book to an inclined support member, where the means just-recited is disposed horizontally across a surface of the inclined support member. This embodiment is particularly well adapted to holding computer fan-fold and other like paper securely for viewing.

BRIEF DESCRIPTION OF THE DRAWINGS

Other objects, advantages and features of the present invention will become apparent to one skilled in the art upon reading the following description and appended claims, taken in conjunction with the following drawings, wherein:

DETAILED DESCRIPTION OF THE PREFERRED EMBODIMENTS

Figure 1:
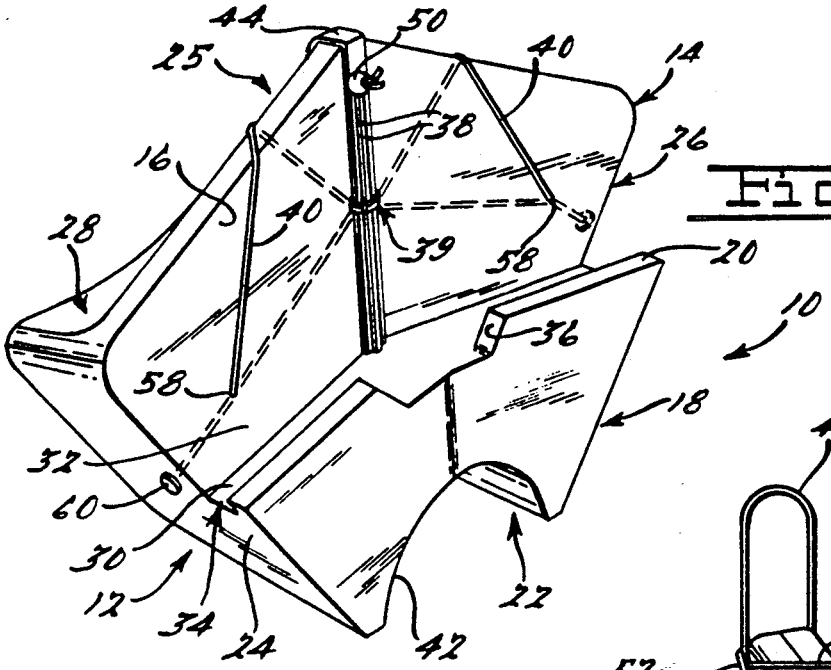
FIG. 1 is a perspective elevational view of a book holder in accordance with a preferred embodiment of the present invention.

Referring to FIGS. 1 through 6, there is shown a book holder 10 in accordance with a preferred embodiment of the present invention. The book holder 10 comprises an integrally formed base 12 molded from a foamable plastic. The base generally includes an inclined support member 14 having a front surface 16, a front portion 18 spaced apart laterally from the front surface 16 and having a protruding shoulder portion 20; a bottom portion 22, side portions 24 and 26; a top edge portion 25; and a rear portion 28.

The front portion 18 further includes a generally planar support surface 30 which together with protruding shoulder portion 20 and a lower portion 32 of the front surface 26 forms a channel 34 within which a lower edge surface of a book 27 (shown in phantom in FIG. 4) may be supported and at least partially confined when the book 27 is in an open position and resting against the front surface 16. A cut-out section 36 in the protruding shoulder portion further enables the book 27 to be more easily placed within the channel 34 and the pages of the book 27 to be viewed more easily.

The inclined support member 14 further includes a first elastic strap 38 which vertically bisects the front surface 16 of the inclined support member 14. A second elastic strap is also disposed over and through portions of the front surface 16. The first elastic strap 38 is adapted to be placed over the central or binder area of the book 27 when the book 27 is in an open position and placed within the channel 34, to secure the book 27 to the inclined support member 14. The second elastic strap 40 is used to hold the pages of the book 27 open to enable one to perform other activities such as typing, note taking, etc., while reading the book.

Figure 5:
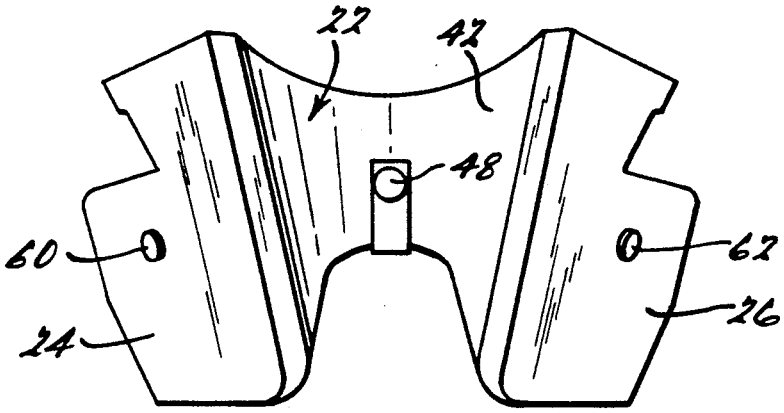
FIG. 5 is a bottom view of the book holder of FIG. 1.

As seen in FIGS. 1 and 5, the bottom portion 22 of the base 12 includes a generally semi-circular cut-out section 42 which enables the base 12 to be placed over the leg of an individual while the individual is in seated or semi-seated positions, such as sitting up in bed.

Figure 1A:
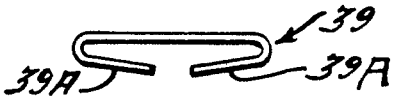
FIG. 1A is a plan view of an optional clip used to help secure relatively small books in an open position.

In a preferred embodiment of the invention the book holder 10 includes a carrying strap 44 which is secured to the bottom portion 22 and the rear portion 28 of the base 12. The carrying strap 44 enables the book holder 10 to be carried easily with one hand. An optional clip 39 is also illustrated being slidably disposed on the carrying strap 44. The clip is shown particularly well in FIG. 1A and enables the sections of the carrying strap 40 to be releasably, temporarily secured thereto by hooking in portions of the second elastic strap 40 over arm portions 39A of the clip 39 to enable the second elastic strap 40 to be used more easily with smaller books such as small paperbacks. Thus, by sliding the clip 39 up or down on carrying strap 44, books of widely varying sizes can be readily secured in open positions.

Figure 3:
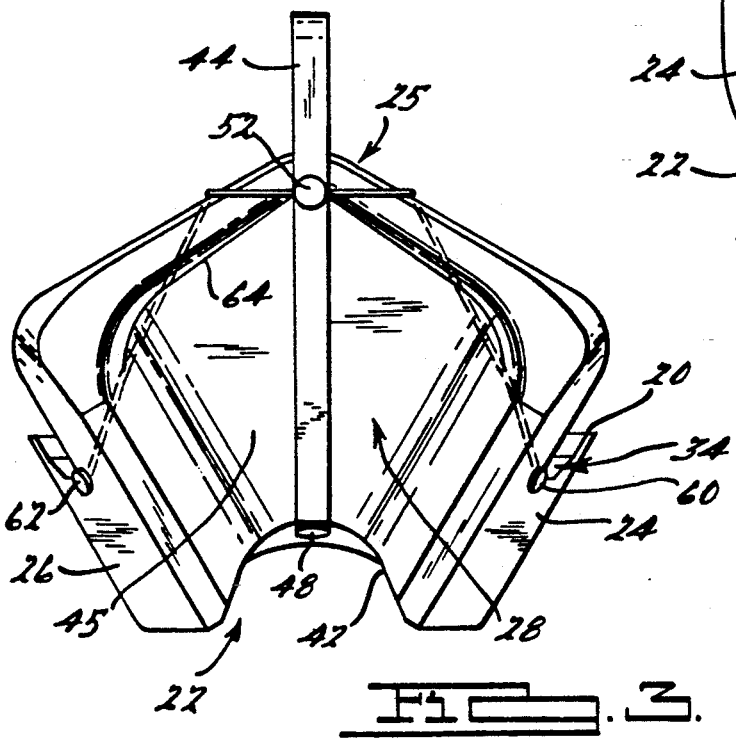
FIG. 3 is a rear elevational view of the book holder of FIG. 1.

As illustrated particularly well in FIGS. 1 and 3, the side portions 24 and 26 are angled to diverge outwardly from each other relative to the bottom portion 22 of the base 12. This angling enables the base 12 to be rested on either of the side portions 24 and 26 while a book is secured thereto to enable reading of a book while laying on one's side in bed.

With brief reference to FIG. 3, it can be seen that the rear portion 28 comprises a generally concavely shaped section 45. The concave shape further enables the base 12 to be formed with less material, thereby producing a structure which is lighter in weight and yet which still comprises good stability and good rigidity.

Figure 4:
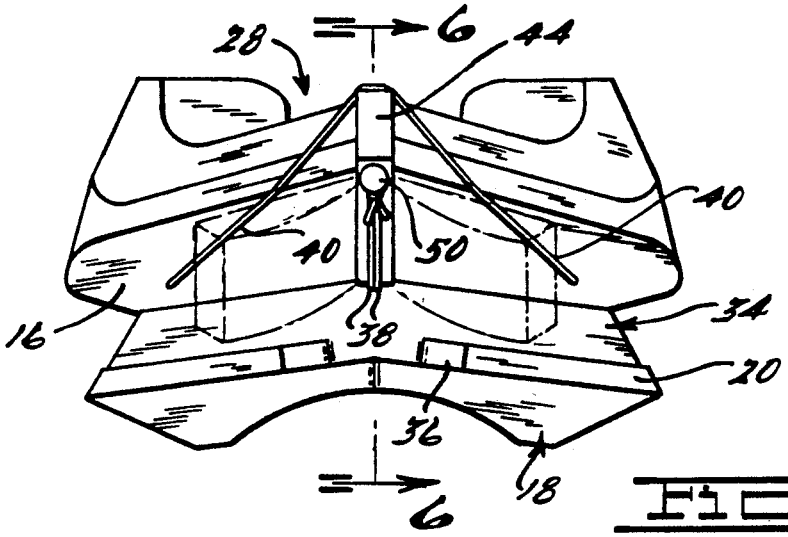
FIG. 4 is a top plan view of the book holder of FIG. 1.
Figure 6:
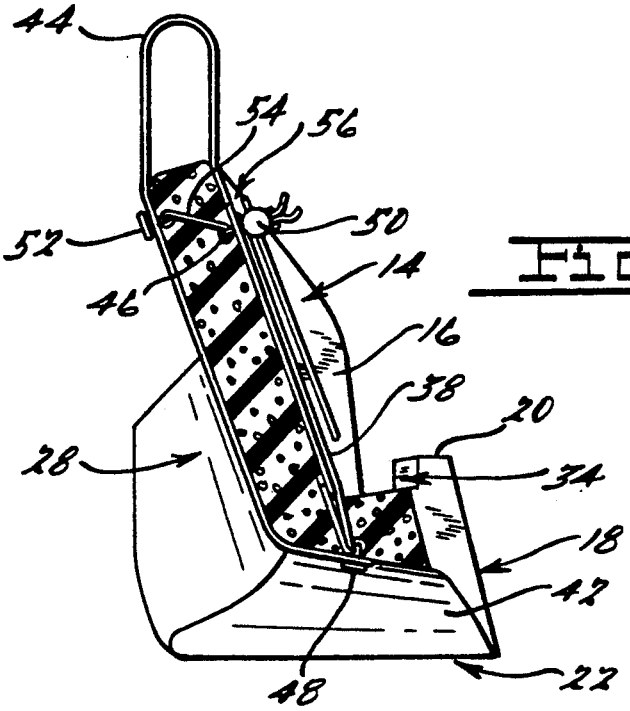
FIG. 6 is a cross-sectional side view of the book holder of FIG. 4 taken in accordance with section line 6—6.

Referring now to FIGS. 3, 4 and 6, it can be seen how the first and second elastic straps 38 and 40 are secured to the base 12. With specific reference to FIG. 6, the first elastic strap 38 is wrapped over an independent section of elastic 46 and secured at both of its ends to a button 48 positioned within the semi-circular cut-out section 42 of bottom portion 22. The carrying strap 44 is also secured to the button 48. Elastic section 46 is in turn secured to a wooden ball 50 and also to a button 52 via another section of elastic 54. The button 52 also preferably extends through a portion of the carrying strap 44. Thus, by lifting upwardly and outwardly on the sections of the first elastic strap 38, an end portion 56 of the first elastic strap 38 may be removed from its position behind the wooden ball 50 and book 27 placed within the channel 34. The first elastic strap 38 may then be placed over the central or binder area of the book 27 and reattached over elastic section 46 immediately behind wooden ball 50, to thereby secure the book 27 to the inclined support member 14 front surface 16. Accordingly, this arrangement enables books of widely varying thicknesses to be easily and conveniently secured to the book holder 10.

With reference to FIGS. 1, 3 and 4, it can be seen particularly well how the second elastic strap 40 is secured to the base 12. The second elastic strap 40 extends partially over the front portion 16 of the inclined support member 14 and through holes 58 in the front surface 16, extending through interior areas of the base 12 and is secured at its opposing end portions to the side portions 24 and 26 by buttons 60 and 62, respectively. Referring specifically to FIG. 3, it can also be seen that the second elastic strap 40 extends over the top portion 25 of the base 12 and is secured underneath button 52. It should be appreciated, however, that minor variations of the placement of the second elastic strap 40 may be made. However, it has been found that spacing portions of the strap 40 on opposing sides of the first elastic strap 38 works particularly well in securing the pages of a book releasably in an open position.

Figure 2:
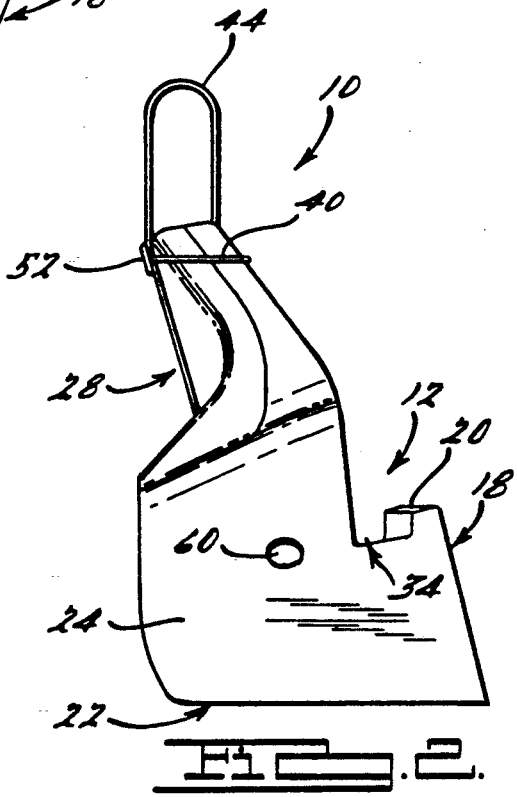
FIG. 2 is a side elevational view of the book holder of FIG. 1.

With further reference to FIGS. 2 and 3, it can also be seen that the rear portion 28 includes a ledge portion 64 which further enables the base 12 to be carried in the event it is desired not to incorporate carrying strap 44.

Referring to FIG. 1, the bisected portions of the front surface 16 of the inclined support member 14 are further angled slightly towards each other in converging fashion, while also being inclined slightly, as shown in FIG. 6, to tilt a book slightly for better viewing comfort.

In constructing the base 12, a preferred material is a polyurethane self-skinning foam. However, polyvinyl or polyvinyl copolymer foam reaction mixtures and other like mixtures known in the art are also suitable. For an outer covering, a preferred paint which works particularly well is a water-based paint, available from the Flexabar Corporation of Northvale, N.J.

Figure 7:
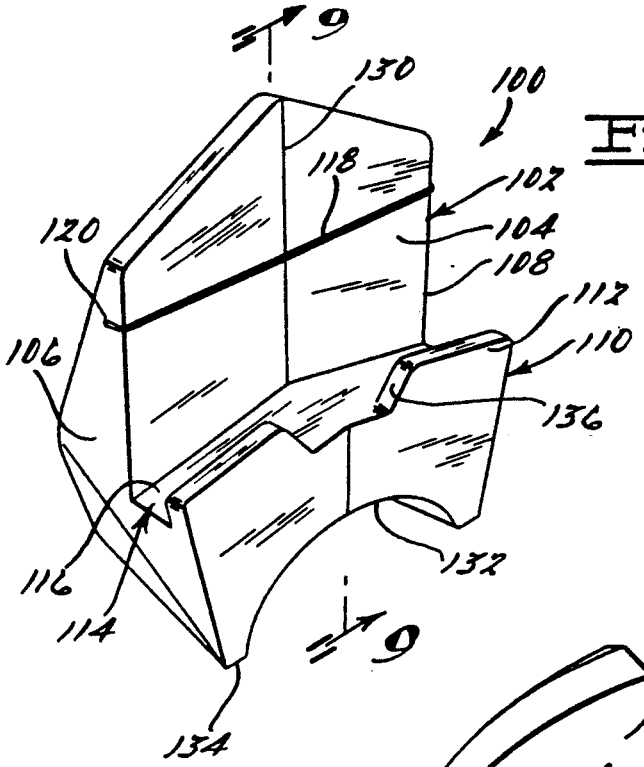
FIG. 7 is a perspective view of a book holder in accordance with an alternative preferred embodiment of the present invention.
Figure 8:
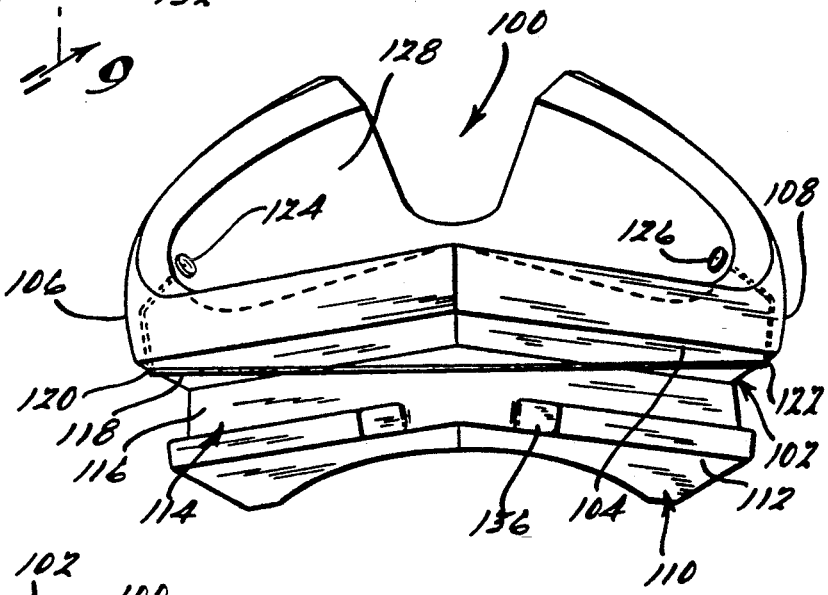
FIG. 8 is a plan view of the book holder in FIG. 7.
Figure 9:
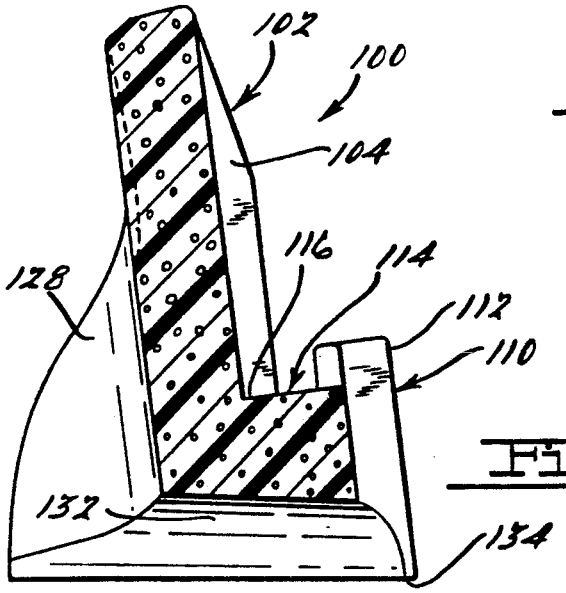
FIG. 9 is a side cross-sectional view of the book holder of FIG. 7 in accordance with section line 9—9 in FIG. 7.

Referring now to FIGS. 7 through 9, a book holder 100 in accordance with an alternative preferred embodiment of the present invention is illustrated. This embodiment 100 generally includes an inclined support member 102 having a front surface 104, side portions 106 and 108, and a laterally spaced-apart front portion 110 having a protruding shoulder portion 112 cooperating with a portion of the front surface 104 to form a channel 114 having a generally planar support surface 116.

The inclined support member 102 further includes a horizontally disposed elastic strap 118 which extends across the front surface 104 and through portions of the inclined support member 102 via apertures 120 and 122. The opposing ends of the elastic strap 118 are secured by buttons 124 and 126 at a rear wall portion 128 of the book holder 100, as shown particularly well in FIG. 8.

With specific reference to FIG. 7, it can be seen that the side portions 106 and 108 extend generally parallel to a vertical center section 130 of the front surface 104. The front portion 110 further includes a generally semi-circular cutout section 132 which extends through a bottom portion 134 to the book holder, as is particularly well shown in FIG. 9. The front portion 110 further includes a cut-off section 136 to enable easier access to the pages of a book being held by the book holder 100.

The horizontally disposed elastic strap 118 is particularly well adapted for releasably securing papers such as computer fan-fold paper to the front surface 104 for easy and convenient reading. Book holder 100 can also be placed over a light or on its side in the same manner as described in connection with book holder 10 of FIGS. 1 through 6.

The book holder 100 is further constructed of materials and in a manner preferably identical with book holder 10 of FIGS. 1 through 6.

While the above description constitutes the preferred embodiments of the invention, it will be appreciated that the invention is susceptible to modification, variation, and change without departing from the proper scope or fair meaning of the accompanying claims.

What is claimed:

1. A book holder comprising:

an integrally formed base molded from a foamable plastic;

said base having an inclined support member having a front surface including a top edge portion and a lower edge, a front portion spaced apart from said inclined support member, said front portion including a protruding shoulder portion;

said front portion having a generally planar support surface, said support surface, protruding shoulder portion and a portion of said inclined support member cooperatively defining a channel for supporting and confining a lower edge surface of a book;

securing means associated with said inclined support member for releasably securing said book in an open position against said front surface of said support member; and said securing means including an elastic strap having first and second portions extending over said inclined support member on opposite sides of said front surface, each said portion being laterally spaced apart from said at said top upper and lower edges of said front surface of said inclined support member and extending over said top edge portion of said front surface, each of said first and second portions of said elastic strap further being disposed over said front surface of said inclined support member at an angle relative to a vertical center line of said front surface to restrain only upper corner portions of said book.

2. The book holder of claim 1, wherein said securing means comprises a first elastic strap vertically bisecting said inclined support member for securing a binder portion of said book to said front surface; and at least a second elastic strap extending over said inclined support member on opposite sides of said front surface for releasably maintaining pages of said book in an open position.

3. The book holder of claim 1, further comprising a carrying strap secured to said inclined support member for enabling said base to be easily carried.

4. The apparatus of claim 1, wherein said front surface includes a cut-out section to enable said book to be easily secured to said inclined support member by said securing means.

5. The book holder of claim 1, wherein said base includes a bottom portion, said bottom portion including a generally semi-circular cut-out section extending therealong for enabling said bottom portion to be placed comfortably over a leg, to thereby permit said book holder to be used by an individual while said individual is in seated and semi-seated positions.

6. The book holder of claim 1, wherein said base has side portions extending in diverging relationship relative to each other from said bottom portion.

7. The book holder of claim 1, wherein said base includes a rear portion, said rear portion including a ledge portion for enabling said base to be better grasped and manually handled.

8. A book holder for releasably holding a book in an open position, said book holder comprising:

an integrally formed base molded from foamable plastic;

said base including an inclined support member having a front surface, a top edge portion, a front portion spaced apart laterally from said inclined support member, said front portion including a protruding shoulder portion and a transversely extending, generally planar support surface, said protruding shoulder portion, said support surface and said inclined support member cooperating to define a channel operable to support and at least partially confine a lower edge surface of a book when said book is in an open position and said lower edge surface is resting within said channel;

said inclined support member including a first elastic strap vertically bisecting said front surface of said inclined support member;

a second elastic strap having first and second portions extending through portions of said front surface of said inclined support member and over said top edge portion of said inclined support member on opposing sides of said first elastic strap and being secured to said side portions of said base, and also to said rear portion at a position closely adjacent said top edge portion of said inclined support member, – each of said first and second portions of said elastic strap further being disposed over said front surface of said inclined support member at an angle relative to said first elastic strap.

9. The bookholder of claim 8, wherein said base further includes a bottom portion having a generally semi-circular cut-out section to enable said bottom portion to be placed comfortably over a leg of an individual while said individual is in seated and semi-seated positions.

10. The book holder of claim 8, further comprising a carrying strap extending generally parallel to said first elastic strap and secured to a bottom portion of said base and said rear portion for enabling said base to be easily handled and transported.

11. The book holder of claim 8, wherein said protruding shoulder portion of said front portion includes a cut-out section for enabling said book to be more easily secured to said inclined support member.

12. The book holder of claim 8, wherein said base further includes side portions and a bottom portion, said side portions being angled to diverge outwardly from each other relative to said bottom portion.

13. The book holder of claim 12, wherein said opposing end portions of said second elastic strap extend through said side portions and are secured to said side portions by a pair of buttons.

* * * * *

UNITED STATES PATENT AND TRADEMARK OFFICE

CERTIFICATE OF CORRECTION

PATENT NO. : 5,165,648

DATED : Nov. 24, 1992

INVENTOR(S) : Wanda L. Quigley

It is certified that error appears in the above-identified patent and that said Letters Patent is hereby corrected as shown below:

Col. 1, Line 41: delete "is".

Col. 4, Line 1: after "14" insert --of--.

Col. 5, Line 34, Claim 1: delete "from said".

Col. 5, Line 34, Claim 1: delete "upper".

Col. 6, Line 42, Claim 9: "bookholder" should be --book holder--.

Signed and Sealed this

Twenty-eighth Day of December, 1993

*Attest:*

Bruce Lehman

BRUCE LEHMAN

*Attesting Officer*

*Commissioner of Patents and Trademarks*